US006777586B1

(12) United States Patent
Arcuri et al.

(10) Patent No.: US 6,777,586 B1
(45) Date of Patent: Aug. 17, 2004

(54) RECLAIMING RDX AND TNT FROM COMPOSITION B AND COMPOSITION B CONTAINING MILITARY SHELLS

(75) Inventors: Kym B. Arcuri, Tulsa, OK (US); Duane A. Goetsch, Andover, MN (US); Ryan M. Smith, Minnetonka, MN (US); Steven J. Schmit, Ramsey, MN (US); Paul L. Miller, Harvest, AL (US)

(73) Assignee: Gradient Technology, Blaine, MN (US)

( * ) Notice: Subject to any disclaimer, the term of this patent is extended or adjusted under 35 U.S.C. 154(b) by 0 days.

(21) Appl. No.: 10/444,442

(22) Filed: May 23, 2003

(51) Int. Cl.[7] ..... D03D 23/00

(52) U.S. Cl. ..... 588/203; 588/202; 149/124; 149/109.6

(58) Field of Search ..... 149/124; 588/202, 588/203; 86/50

(56) References Cited

U.S. PATENT DOCUMENTS 5,445,690 A * 8/1995 Wulfman ..... 149/109.6
5,953,679 A * 9/1999 Morris ..... 588/202
5,977,354 A * 11/1999 Spencer et al. ..... 540/475
6,110,308 A * 8/2000 Ewald et al. ..... 149/109.6

* cited by examiner

*Primary Examiner*—Aileen B. Felton
(74) *Attorney, Agent, or Firm*—Henry E. Naylor; Kean, Miller, Hawthorne, D'Armond, McCowan & Jarman LLP

(57) ABSTRACT

A solvent extraction process for the separation recovery of TNT and RDX from Composition B-containing munitions. The munitions also contain liner materials, such as asphalt and binders, and sealers, such as wax, each of which are also recovered by use of solvent technology.

23 Claims, 1 Drawing Sheet

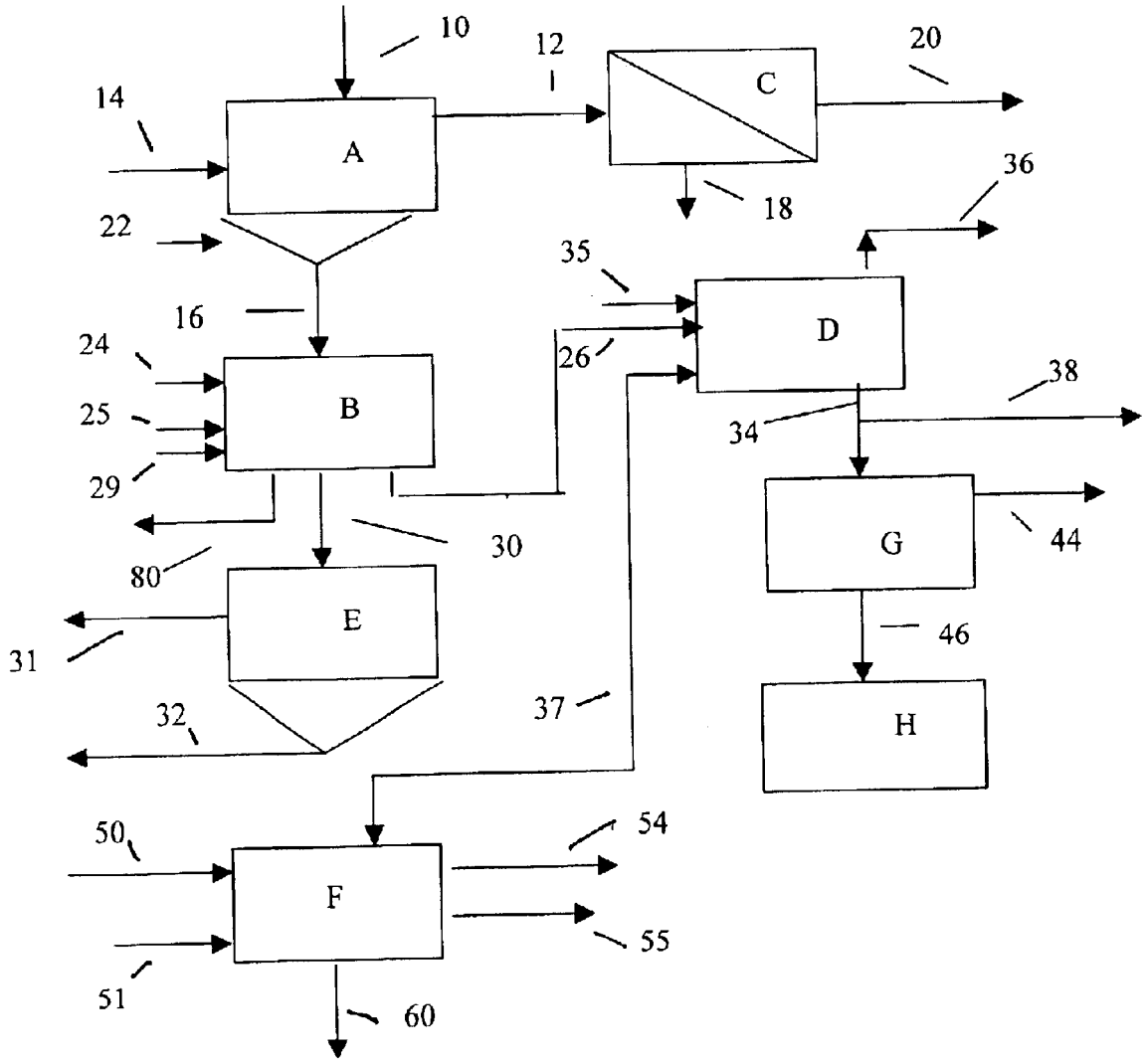
10
12
20
14
A
C
18
36
22
35
16
D
24
26
38
25
B
34
29
G
44
30
80
E
46
31
37
H
32
50
54
F
55
51
60

RECLAIMING RDX AND TNT FROM COMPOSITION B AND COMPOSITION B CONTAINING MILITARY SHELLS

FIELD OF THE INVENTION

The present invention relates to a process for the recovery of TNT and RDX from Composition B-containing munitions. The munitions also contain non-explosive materials, such as a liner, a sealer, and a desensitizing agent.

BACKGROUND OF THE INVENTION

Surplus munitions present a problem to the US military. Current budget constraints force the US military to prioritize its spending while effectively defending the interests of the United States. Defense budgets are further tightened because aging and surplus munitions must be guarded and stored. The US military regularly destroys a significant amount of its surplus munitions each year in order to meet its fiscal challenge. It also destroys a significant amount of munitions each year because of deterioration or obsolescence.

In the past, munitions stocks have been disposed of by open burn/open detonation (OBOD) methods—the most inexpensive and technologically simple disposal methods available. Although such methods can effectively destroy munitions, they fail to meet the challenge of minimizing waste by-products in a cost effective manner. Furthermore, such methods of disposal are undesirable from an environmental point of view because they contribute to the pollution of the environment. For example, OBOD technology produces relatively high levels of undesirable $NO_x$, acidic gases, particulates, and metal waste. Incomplete combustion products can also leach into the soil and contaminate ground water from the burning pits used for open burn methods. The surrounding soil and ground water must often be remediated after OBOD to meet environmental guidelines. Conventional incineration methods can also be used to destroy munitions, but they require a relatively large amount of fuel. They also produce a significant amount of gaseous effluent that must be treated to remove undesirable components before it can be released into the atmosphere. Thus, OBOD and incineration methods for disposing of munitions become impractical owing to increasingly stringent federal and state environmental protection regulations. Further, today's ever stricter environmental regulations require that new munitions and weapon system designs incorporate demilitarization processing issues. Increasingly stringent EPA regulations will not allow the use of OBOD or excessive incineration techniques, therefore new technologies must be developed to meet the new guidelines.

One type of explosive system that presents a demilitarization problem are military shells that contain Composition B. Composition B is a mixture comprised of 2,4,6-trinitrotoluene (TNT) and cyclotrimethylenetrinitramine (RDX) powder particles as the energetic, or explosive components. Such shells also typically contain an asphalt liner material as well as other non-explosive components, such as a sealer and a desensitizing agent for the RDX particles. The most common method used to remove Composition B from a shell is the use of a steam wand to melt the Composition B from the shell. Another method is to use autoclaves that are large enough to heat the entire shell, thereby melting the energetic material, which will then flow out of an open shell casing. Such methods have the disadvantage of melting not only the Composition B, but also resulting in the removal and mixing of the asphalt liner and resin or wax-like sealer with the explosive components. The use of steam also introduces water that results in so called"pink water" (TNT contaminated water) that must also be treated before it can be released into the environment. Thus, the RDX particles will mix with the TNT, asphalt binder material and sealer. This results in a significant problem because the RDX, TNT, asphalt, and sealer are difficult to separate from each other and purify. Consequently, a significant amount of the RDX powder that becomes dispersed in the sealer and asphalt is unrecoverable.

The asphalt liner has been shown to accelerate the TNT aging process, thus leading to unstable products that could initiate spontaneous exothermic decomposition of the energetic materials. Consequently it is imperative to remove all vestiges of the asphalt liner in order to recover TNT of acceptable purity and stability. Water is also a contaminant in TNT and because it is difficult to separate it from TNT, the commercial value of any recovered TNT is reduced. A blend of such components also prevents its reuse as an explosive and significantly reduces its value in chemical conversion processes.

Another method for separating RDX from TNT is disclosed in U.S. Pat. No. 5,977,354 to Spencer, which is incorporated herein by reference. The Spencer method teaches melting out the TNT/RDX mixture and passing it through a sieve tray that collects the RDX particles contaminated with TNT. The molten TNT passes through the sieve. The collected RDX particles are then contacted with a solvent in which TNT is highly soluble. Through use of the appropriate amount of solvent, the contaminating amount of TNT is removed from the RDX particles allowing recovery of a high purity RDX component that can be re-used as a virgin energetic material. The Spencer method is primarily applicable to bulk material that did not originate from a munition casing since Spencer does not teach the separation and management of other components, such as liner and sealer material that are present in the effluent mixture of the munition cavities.

Further, Spencer does not provide for the recovery of high purity TNT since RDX is soluble in and contaminates the recovered TNT. The presence of trace quantities of RDX, asphalt liner, sealing material, as well as a wax constituent in TNT (>0.5 wt %) can adversely affect its properties and prevent its re-use in high valued applications, such as munitions. As previously mentioned, it is known that small quantities of asphalt adversely affect the impact and thermal sensitivity of TNT recovered from munitions.

While some of the above mentioned methods of recovering and separating TNT from RDX show promise for bulk material comprised of only TNT and RDX, there remains a need in the art for an effective method for separating the variety of components, including both explosive and non-explosive components that are present in Composition B-containing munitions. The present invention teaches the recovery of RDX and TNT of sufficient purity from the non-explosive components to be used in high valued applications such as munitions.

SUMMARY OF THE INVENTION

In accordance with the present invention there is provided a process for recovering the components of a munition containing explosive components and non-explosive components, wherein the explosive components are comprised of RDX in a TNT matrix and wherein the nonexplosive components are selected from a liner material comprised of asphalt and a sealer material comprised of a polymeric material and which non-explosive components are of a lower density than said explosive components, which process comprises:

a) opening said munition to expose said explosive and non-explosive components;

b) removing substantially all of said explosive components and at least a portion of said non-explosive components from the munition, which explosive components and at least a portion of non-explosive components is referred to as the feed matrix;

c) conducting the feed matrix to a first settling vessel containing water and wherein at least a portion of the non-explosive components rise to the surface of the water in said vessel and the explosive components sink at a rate to the bottom;

d) drawing-off water containing non-explosive components and passing it to a solids/liquid separation zone wherein the non-explosive solids are separated from the water, e) recycling at least a portion of the water to settling vessel of step c) above;

f) conducting an aqueous slurry of explosive components from the bottom of said settling vessel to a solvent contacting zone wherein the aqueous explosive components slurry is admixed with an organic solvent that is substantially immiscible in water and in which TNT is soluble and in which RDX is substantially insoluble;

g) conducting an explosive components/water/solvent admixture from said contacting zone to a second settling vessel wherein a TNT/solvent solution organic phase is formed at the upper part of the vessel and an RDX solids in water phase is formed at the bottom part of said second settling vessel;

h) drawing off the TNT/solvent solution and passing it to a liquid/liquid separation zone wherein said solvent is separated from said TNT by a boiling point differential technique thereby leaving TNT in a crystallized form, i) collecting said solvent;

j) conducting the crystallized TNT to a drying zone to remove substantially any remaining liquid therefrom; and k) collecting the RDX solids from step g).

In a preferred embodiment of the present invention the solvent is selected from the group consisting of acetone, ethanol, methanol, and diethylether.

In another preferred embodiment of the present invention the separation technique for separating the non-dissolved RDX particles from the TNT/solvent solution is selected from the group consisting of gravity settling and filtration.

In still another preferred embodiment of the present invention, the dissolved RDX present in the solution containing dissolved TNT is crystallized by the addition of water to reduce the solubility of the dissolved RDX thereby causing precipitation and crystallization resulting in separation and settling from the liquid phase.

In still another preferred embodiment of the present invention the TNT is recovered from the solvent by evaporating the solvent and recrystallizing the TNT.

In yet another preferred embodiment of the present invention the recovered RDX particles are transferred into isopropyl alcohol for storage.

In another preferred embodiment of the present invention the solvent, after TNT separation, is condensed and recycled.

In still another preferred embodiment of the present invention the organic liner material, which remains in the shell after Composition B removal, is removed from the shell casing using a suitable second solvent, which is then flashed off, thereby leaving an organic liner concentrate.

BRIEF DESCRIPTION OF THE FIGURE

The sole Figure hereof is a process flow diagram of a preferred embodiment for practicing the present invention for removing and recovering TNT, RDX and non-explosive components from munitions containing Composition B.

DETAILED DESCRIPTION OF THE INVENTION

Recovery and reuse methods, such as that of the present invention, are the most attractive alternative to the conventional destructive methods discussed above and can be used to recover substantially all of the components of the munition with very little waste generation. This state-of-the-art technology is feasible, safe, and relatively inexpensive. It also has the potential of meeting the recovery and reuse goals of demilitarization. Future demilitarization operations will be dominated by chemical conversion and recovery technologies that recover or convert the explosives and other components used in munitions manufacture to materials that can be recycled, or resold, in a cost effective environmentally acceptable manner.

Munitions on which the present invention can be practiced are those munitions containing Composition B as the energetic (explosive) component. Composition B is a mixture of TNT and RDX particles. The term"munition" as used herein refers to a military shell that contains Composition B, which military shell includes both projectiles and bombs. The typical amount of TNT found in Composition B is at least about 35 wt. %, preferably at least about 40 wt. %, more preferably greater than 50 wt. %, and even as high as 4:1 TNT to RDX. One specific Composition B composition contains about 39.5 wt. % TNT and 59.5 wt. % RDX. The munition cavity is typically coated on its interior surface with an organic liner material. Non-limiting examples of organic liner materials that are used for military shells include asphaltic liners, paints, and any other suitable liner material that provides a chemically stable coating that is capable of preventing the explosive components from contacting the metal casing.

In most cases, a sealer material is used to fill a gap left after the shell is filled with the explosive component. For example, a shell, or munition casing, is typically filled with molten explosive material that upon solidification will undergo a relatively small amount of shrinkage that will leave an unacceptable void or space. This space will be filled with a suitable sealer material that will undergo little, if any, shrinkage upon solidification. Examples of sealer material are provided under military specification MIL-S-3105B and MIL-S-3105C. After the empty space is filled with sealer material the shell is closed by screwing on a suitable end piece. The sealer material will typically be comprised of such things as natural and synthetic waxes, natural or synthetic resins, and any other similar materials that are typically used for sealing the filling end of the shell. The presence of such liner and sealer materials makes it difficult to obtain relatively pure yields of TNT and RDX from munitions.

In the practice of the present invention, TNT and RDX powder particles are recovered from each other and from the liner, sealer, and any other non-explosive material used in the manufacture of the munition. Conventional methods for disposing of Composition B-containing military shells, such as melting, incineration, chemical degradation, and detonation are not capable of recovering the TNT and RDX powder as discrete components from the non-explosive components.

One preferred embodiment for practicing the present invention is by first cutting open the shell, or casing, to expose its contents for removal. Any suitable technique can be used to open the shell and expose its contents. One preferred technique is the use of fluid-jet cutting technology that is effective to not only cut open the shell, but which can also erode, or comminute the explosive components during wash-out. Fluid-jet cutting technology is disclosed in U.S. Pat. Nos. 5,363,603 and 5,737,709 both of which are incorporated herein by reference. It is preferred that the washout pressure be high enough to washout the Composition B, but low enough to leave as much of the liner material in the shell casing as possible. The preferred type of fluid jet washout equipment that can be used in the practice of the present invention is described in U.S. Pat. No. 5,737,709. The operating pressure of the fluid jets will be from about 20,000 to about 150,000 psi, preferably from about 40,000 to about 150,000 psi. The diameter of the washout jet stream will typically be in the range of about 0.001" to about 0.02". Although it is preferred to washout the explosive components without washing out any of the non-explosive components, in commercial practice at least a portion of the non-explosive components will be washed out with the explosive components.

While the shell can be cut across its longitudinal axis at a point that will expose substantially all of the components for removal, it is preferred to expose the explosive component by defuzing the shell. That is, by cutting around the fuze until it is free from the casing. This, or course is preferred for safety reasons.

Several approaches can be taken once the components of the shell are exposed. It is preferred to use the fluid jet to fracture and reduce the resulting solids explosive component to sufficiently small particles that will allow it to flow out of the munition casing and accumulate within a volume capable of effecting a separation of constituents based on the differences in density of the constituents. A solvent treatment can then be applied to the material collected in the bottom of the separator volume. As the effluent form the munition cavity enters into the separator vessel, the heavier or higher density constituents will accumulate at the bottom. The explosive materials being of higher density than the fluid jet liquid and other constituents present within the munition cavity can contact the solvent in a mixing volume located at the bottom of the separator volume. The height of accumulated material above the mixing volume will preferably be greater than about 2 ft. in order to prevent the passage of any solvent vapor upwards through the lower density materials located in the upper portions of the settler volume. The constituents obtained from the munition casing are contacted with a series of fluids that function either as solvents and/or as the continuous phase for gravity based separation. A number of separation steps are necessary because of the number of different types of constituents that exit the munition during the accessing step. The separation steps involve removing the explosive components (RDX and TNT) from the non-explosive constituents such as an asphalt liner, sealer, aluminum powder if present, and any other material that was used in the manufacture of the munition. The mixture derived from the munition cavity is referred to as the feed matrix. The sequence of steps depends upon the type of ingredients that comprise the feed matrix. The preferred munition will be comprised of a shell casing having its interior lined with asphalt and filled with Composition B and sealed with a sealer material before the endcap is secured.

Solvent, as well as water can be used to remove remaining non-explosive material from the cavity. The liner material obtained in this step is combined with the liner material recovered in the initial settling operation on the feed matrix. The liner material can either than be allowed to air dry for the recovery of wet material or dissolved in a solvent which is immiscible with water. The solution containing the liner material can than be processed through an evaporation and drying step and then recovered as a dry water free material.

In a preferred embodiment, the feed matrix, or effluent is comprised of non-explosive components and explosive components and is physically removed from the munition cavity and passed to a settling zone which collects the effluent from the munition during accessing. As previously mentioned, the preferred method of opening and removing the explosive and non-explosive components of the munition is by use of fluid jet technology. The higher density constituents (TNT and RDX) are allowed to settle and are contacted with a solvent that possesses a relatively high solubility towards TNT and a lesser or negligible solubility towards RDX. This results in a slurry of RDX particles in a TNT/solvent solution that may also contain a small amount of dissolved RDX. It is preferred that as much of the liner be left in the munition as possible for further washout. However some of the liner, typically asphalt, will most likely be removed along with sealer material and the explosive components. The asphalt liner, being less dense than the explosive components will rise to the surface and preferentially be carried out through an overflow of the settling vessel that is used to collect the effluent, or feed matrix from the munition during washout. The use of a solvent in which TNT is preferentially soluble has the preferential affect of leaving the RDX as solid particles that enables relatively easy downstream solid liquid separation from the resulting slurry. The preferred temperature for collecting the effluent from the munition cavity and separating its components is between about 25° and 70° C. The washout process may employ higher initial temperatures (70° to 90° C.) in order to facilitate the rapid removal of material from the munition cavity. However, as the effluent slurry from the munition cavity enters the settling vessel the slurry may be allowed to cool.

As previously mentioned, a preferred solvent used in the practice of the present invention is one in which substantially all of the TNT will dissolve at the process temperature. Non-limiting examples of solvents suitable for use in this step include ethanol, isopropyl alcohol, cyclohexanone, methanol, acetone (preferably cold acetone at temperatures less than about 10° C.), benzene, carbon tetrachloride, dimethyl sulfoxide, ethyl ether, diethyl ether, isobutanol, methyl acetate, ethyl acetate, butyl acetate, xylene, and mixtures thereof Additionally toluene can be used since it possesses a high solubility towards TNT with negligible solubility towards RDX. Preferred solvents are ethanol, isopropyl alcohol, and methanol, with ethanol being more preferred. In a preferred embodiment, little, if any, RDX will be dissolved along with TNT in the solvent. It is preferred that such small amounts of RDX be less than about $1/10^{th}$ the mass of TNT dissolved. The slurry containing RDX solids and solvent with dissolved TNT, and to a lesser extent dissolved RDX, is conveyed to a second vessel which serves as a settler in addition to having the capability of adding incremental amounts of water to the slurry and changing the temperature to allow vaporization of the solvent.

The slurry containing RDX solids and the TNT/solvent component containing small quantities of RDX is sent to a second settling vessel wherein RDX particles settle and are removed and transferred to a volume for subsequent washing to remove residual liquid containing dissolved TNT. The washing agent is preferably a material that possesses negligible solubility towards RDX and a relatively high solubility towards TNT.

The recovered RDX may contain approximately 0.5 to 2 wt % wax-like material. By wax-like, we mean both natural and synthetic wax materials used for desensitizing the RDX particles. For example a wax like material described under Mil-W-20553 or a hydrocarbon plastic-based wax such as a polyethylene emulsion as set forth in Mil-E-63218. In order to secure a high value yield for the recovered RDX, it is desirable to remove this wax. The RDX recovered from the RDX recovery vessel can be washed with an aliphatic solvent such as hexane, or other lower boiling paraffin. This step is preferably performed after removing residual TNT. Upon removal of the wax desensitizing agent the RDX is combined with isopropyl alcohol and water, or as appropriate to meet the requirements of DOT 49 CFR 172 et seq for the safe storage and shipment of a hazardous material.

Any small amount of RDX dissolved in the solvent can be removed by incrementally adding water to the TNT/solvent solution. The added water will preferentially crystallize the residual RDX present in the TNT solution. Some TNT may crystallize along with the residual RDX. The addition of water preferably occurs in small increments within the liquid phase which is well mixed by the use of any suitable mixing apparatus. The amount of water to be added depends upon the specific solvent used. For example, when acetone is the solvent, the amount of water to be added in each increment will preferably correspond to about 1 to 5 wt. % of the acetone inventory in the vessel. After thoroughly mixing the added water, the mixer should be turned off and the solids allowed to settle. A sample of the liquid phase can be analyzed by any suitable technique, such as by GC (gas chromatography) to determine the residual RDX levels remaining in the solution after each incremental water addition. It is preferred that the residual RDX remaining should correspond to less than about 0.2 wt % of the TNT in order to obtain high valued material. In cases where high purity is not necessary, the water addition steps can be limited in number or completely eliminated. In some cases it may be desirable to add larger amounts of water (i.e. 10 wt % in a single addition step). In these cases the dissolved residual RDX is removed in a shorter time period, however losses through co-crystallization of TNT may be greater.

The solvent used for dissolving the TNT will preferably have a relatively high vapor pressure so that it can be flashed-off and a relatively simple separation step used to recover the TNT from the solvent. The preferred solvent preferentially dissolves the TNT which then allows the solid RDX particles to be separated therefrom by utilizing conventional solid-liquid separation techniques. Also, a preferred solvent will not dissolve the organic liner or the polymeric sealer material. More preferred solvents include methanol, ethanol, diethyl ether, and acetone. The most preferred solvent is acetone in which TNT at least about 10 times more soluble than RDX. The amount of solvent used will be an effective amount. That is, at least that amount needed to result in the desired level of TNT dissolved in the solvent. The precise amount used will depend on a variety of factors. For example, although it is desirable to use the minimum amount necessary for dissolving substantially all of the TNT, additional amounts of solvent can also be used. One factor that may determine the amount of TNT used will be based on safety concerns involving explosive mixtures. The minimum amount of solvent employed in dissolving the TNT will be set by the volume requirements to ensure a flammable but non-explosive mixture. It is within the scope of this invention that the Composition B be washed out of the shell by use of a jet of water, or a jet of solvent in which the TNT is soluble and the RDX and non-explosive components are essentially insoluble. The preferred method is to employ water as the wash out material in which all components are essentially insoluble.

After all of the chemical components have been removed from the munition, the munition casing can now be recovered by cleaning it with water or an appropriate solvent to achieve a desired 5×cleanliness. Both the liner and sealer material can be removed by use of fluid jets or simple solvation with an appropriate solvent, or a combination solvation/fluid jet washout process. It is preferred that the fluid jet washout step be able to achieve a 5×cleanliness that is required by Army Material Command Regulation 385-5 for explosives and Army Material Command Regulation 385-61 for chemical weapons.

Turing now to FIG. 1 hereof, the explosive and non-explosive components removed from the munition casing will include TNT, RDX, at least a portion of the liner material, at least a portion of the sealer material, and in some cases other organic material that may include a desensitizer material that is used to coat the RDX particles. These components can be collectively referred to as the"effluent" or"feed matrix". The feed matrix, as it is removed from the munition cavity, can pass along a trough (not shown) in order to ensure that relatively large agglomerates of solids (approximately >0 microns) are collected and not passed on to the next process step. These large agglomerates will primarily consist of the sealer material and they can be removed from the system manually with periodic inspections of the trough. When employing water jet accessing, the particle size of the sealer material will generally be reduced to sizes finer than about microns and subsequent separation steps will remove these finer particles.

The feed matrix is passed via line 10 into first settling zone A. This first settling zone, which can be referred to as the primary settler or primary settling zone, as well as the other zones in this process will typically be comprised of a vessel of suitable size and composition for its intended purpose. Also, ancillary equipment, such as pumps and valves are not shown for simplicity and the design of such is within the ordinary skill of those in the art. It is preferred that this first settling zone A be operated in a water continuous mode such that the TNT and RDX which have specific gravities on the order of about 1.6 or higher will preferentially settle while the lighter lining and sealer materials will preferential float out with the overflow 12 from the settling zone A. That is, a continuous stream of water is introduced toward the bottom of zone A via line 14 at an effective rate to ensure the proper up-flow of water through the vessel to impart the desired separation of the explosive components from the lighter non-explosive components. The settler A is sized so as to allow recovery of the appropriate volume of settled explosives while providing an upward flow of water at a velocity less than the settling velocity of the TNT and RDX components. The preferred velocity for the water flow upwards through vessel A is generally from about 0.2 to about 0.5 cm/sec. Lower flow rates (<0.2 cm/sec) may be preferred in cases where there is a significant amount of lighter constituents (i.e, liner or sealing materials) and the objective is to remove as much as this material in the primary separation step as possible. As can be seen in FIG. 1, the water inlet line 14 is located lower (closer to the bottom of the vessel) than the outlet line 12.

The TNT may be in a solid or molten state as it exist the munition cavity. The preferred state of the TNT is a liquid, and the use of a water jet which generates liquid temperatures on the order of about 82° to about 84° C. is preferable since TNT will exist in the liquid state. However in some cases there may be significant heat loss resulting in solidification of the TNT as it enters and passes through the collection and settling volumes. Supplemental heat provided with steam may be necessary to maintain the TNT in the liquid state. Alternately, the collection and settling volume may be designed to accommodate for the collection of solid TNT (although this is not preferred).

The heavier energetic components, TNT and RDX will settle to the bottom of first settling zone A wherein a solvent that is selective with respect of TNT is introduced via line 22. The solvent will have the same requirements as previously mentioned for being a solvent selective for TNT but not for RDX. That is, an organic solvent in which TNT is substantially soluble and in which RDX is substantially insoluble or has a significantly lower solubility than TNT on a mass basis. It is preferred that the solvent be one that is substantially miscible in water and one in which TNT is at least twice, more preferably at least 3 times, and most preferably at least five times more soluble than RDX. The TNT and RDX components can contact the solvent using a number of methods known to those skilled in the art. These include piping arrangements such as induction tees or mixing volumes employing high velocity fluid contactors. Upon contacting the solvent, the temperature of the TNT/solvent mixture can be reduced to that of near ambient conditions or lower in order to minimize the amount of RDX dissolved with the TNT. The solvent can be introduced at temperatures below ambient in order to facilitate cooling. The preferred temperature for contacting the solvent with TNT is from about 20° to about 50° C. except for acetone where the preferred temperature is from about 10° to about 30° C.

The use of such a solvent allows zone B to be operated at the relatively low temperatures of about 20° to about 50° C. Although temperatures from about 20° C. to about 60° C. are more preferred, solvent contacting zone B can be operated at temperatures from about 0° C. to about 100° C., preferably from about 10° C. to about 80° C., and most preferably from about 20° C. to about 50° C., except for acetone where the preferred temperature is from about 10° to 30° C. Such lower operating temperatures help to ensure that only small amounts, if any, of RDX will dissolve in the solvent phase. The amount of solvent needed for dissolution of the TNT is set by a number of factors. Although it is desirable to add a minimum amount necessary for dissolving substantially all of the TNT there are other safety and process considerations. The minimum amount of solvent is determined by the weight or volume fraction required to render the mixture of TNT non-explosive. Higher levels of solvent are preferred in order to facilitate the separation of residual levels of RDX from the TNT solution as will be described later. Additional solvent is introduced into vessel B via line 24.

A slurry of TNT/solvent/RDX solids is passed to zone B via line 16. It is to be understood that it may be advantageous to allow some of the non-explosive material to be passed with the settled explosive components for any given specific system and for a given flow rate and feed matrix composition. The overflow 12 from primary settling zone A is conducted to separation zone C wherein insoluble lighter constituents such as asphalt liner material are separated, preferably by filtering and collected via line 18. A filtered water stream is collected via line 20 which can be recycled to settling zone A.

As previously mentioned, the TNT/solvent/RDX material passes through the bottom of settling zone A, preferably by gravity flow, via line 16 and enters contacting zone B. It is preferred that the vessel used as zone B be a commercially available system more preferably one referred to as a Nutsche filter design. These filter systems are commercially available through numerous vendors such as Fourcorp, Greenbay Wis. This type of vessel possesses a filter (not shown) across the bottom of the vessel that will allow the TNT/solvent/RDX solids to drain trough the settled RDX solids sitting on the filter. This filter must be appropriately sized so to allow passage of the TNT solution through the settled RDX particles. The settled RDX particles, that will still contain a coating of desensitizing material, preferably a wax, can than be washed with a suitable liquid, preferably hexane, for removing the desensitizing material. Subsequent draining occurs through the settled solids and filter base. The dissolved TNT/solvent solution passes from the bottom of vessel B via line 26 to separation/crystallization zone D for subsequent removal of residual RDX and recovery of the TNT. If acetone is used as the solvent for dissolving TNT, a cooling system may be added to vessel B in order to reduce the temperature and thereby decrease the solubility of RDX in acetone. It is to be understood that although acetone can be used, it may be preferred to use a solvent such as ethanol, methanol or toluene in which RDX is less soluble.

Upon passing substantially all of the dissolved TNT/solvent solution to zone D and washing out residual traces of TNT with solvent added via line 24, the RDX is treated with a second solvent such as hexane or other appropriate solvent introduced via line 25 for removal of the desensitizing agent that is coated onto the RDX particles. The dissolved desensitizing agent in solvent solution is then drained from vessel B via line 80 and sent to a separate collection vessel. The solvent used for removing the desensitizing agent from the RDX can be recovered using an evaporation step and the desensitizing agent can be collected as a pure material or dissolved within the second solvent. The recovered desensitizing agent may have commercial uses, such as for either a fuel or coating material.

The resulting clean RDX is removed from contacting zone B by the addition of a slurrying solvent comprised of a mixture of water and isopropyl alcohol introduced via line 29. The mixture of water and isopropyl alcohol is added at sufficient quantities to fill the vessel to above a drain port (not shown) to allow an overflow of the RDX particles suspended in the isopropyl alcohol water mixture to pass to secondary settling zone E via line 30. Mixers located within the vessel B provide the necessary agitation to suspend the settled RDX particles at the time of draining. The slurry consisting of solid RDX particles in the alcohol/water mixture is transferred via line 30 to settling vessel E. The RDX is allowed to settle in the mixture of alcohol and water and is eventually transferred to storage and shipping containers via line 32, along with the appropriate amount of liquid (water and isopropyl alcohol) in accordance with shipping and storage regulations. The substantially RDX free liquid above the settled RDX solid is drained via line 31 for reuse. During the settling operation in vessel E any residual sealer and liner material will be removed in the overflow due to the density difference compared to RDX. A filter on the overflow line 31 from vessel E can be used to collect the residual liner and sealer material. The sealer and liner material collected on the filter in line 31 are removed and can be treated as solids waste since they will be free of all explosive materials. In the event that there is a significant fraction of either material, they can be combined with similar material obtained from the primary settler.

The RDX contained within the water/isopropyl alcohol mixture settles in the bottom of vessel E. From this point there are transferred to the proper storage and transportation containers along with the appropriate amount of liquid (water and isopropyl alcohol) in accordance with shipping and storage regulations. Since the volume of the water/alcohol mixture necessary for transferring the RDX from the process volume B to process volume E is much greater than that necessary for shipping and storage, the excess liquid will be re-used in subsequent RDX transfer operations.

It is to be understood that settling zones A and E can be operated in any other suitable manner, such as by merely letting the solids settle to the bottom of the aqueous phase then draining it in batch mode. Any sealer material that may have passed with the explosive material through the underflow of the primary water settling vessel (A) will remain with the settled RDX due to the density difference with toluene. This second settling zone E provides additional separation of the RDX from the less dense constituents in the feed matrix such as the sealer material and other solvent insoluble constituents As previously mentioned, the dissolved TNT in solvent solution is conducted to separation/crystallization zone D, which is preferably a suitable flash vessel and contains sufficient extra volume for water addition. The solution containing dissolved TNT (at levels corresponding to about 25 wt % and lesser amounts of RDX (<5 wt. %) is sent to zone D in which crystallization and settling can occur. Since the TNT/solvent solution exiting zone B may contain some dissolved RDX, it will be necessary to crystallize out the RDX with possibly some TNT prior to collecting the bulk volume of TNT as a pure material. Therefore, a small amount of water is added to the solution in zone D. Multiple additions of the small amount of water through line 35 may be necessary for crystallizing out the small amount of RDX dissolved within the TNT solution. The preferred amount of water to be added with each increment is on the order of 1–5 wt % of the mass of solvent present in the vessel. Mixing of the solution containing dissolved TNT with the water is necessary in order to achieve a uniform composition within the liquid volume. The amount of crystallization of the RDX will occur as the water concentration increases to a value which reduces the solubility of the RDX dissolved to the point where it crystallizes and flacks out of solution. The amount of water necessary for accomplishing crystallization of the dissolved RDX will vary depending upon the amount of solvent and the concentration of dissolved TNT. The preferred method is to employ solvent quantities that correspond to TNT concentrations which are less than ½ or 50% of the solubility limit for the particular solvent in use. In the case of acetone where TNT has a very high solubility the amount of solvent to be employed corresponds to a TNT concentration corresponding to ¼ or 25% of the solubility limit.

A slurry of crystallized RDX/water/solvent is passed to settling zone F from zone D via line 37 where a solvent that is selective with respect to TNT is introduced via line 50. This solvent will dissolve the minor amount of TNT from the RDX and the solvent with TNT is collected via line 54. Additional water/isopropyl alcohol mixture is introduced via line 51 into settling zone F to remove contaminants from the crystallized RDX which is collected via line 55. The substantially clean crystallized RDX is collected via line 60.

Additional amounts of water are introduced via line 35 into zone D to crystallize TNT. The crystallized TNT passes through the bottom of vessel D via line 34 while the vapor phase solvent is collected overhead via line 36, condensed and recycled back for use in zones A and B. The vessel of zone D is of a suitable design to prevent the accumulation of TNT deposits arising from solvent vaporization. A scrubber or other type of periodic solvent wash system (not shown) can be employed to prevent the accumulation along the vapor condensing line.

The crystallized TNT exiting via line 34 from the bottom of the zone D may be of acceptable purity for reuse as virgin material and can be sent via line 38 to drying in, for example in a conventional kettle drier may be used for preparing TNT, or Tritonal munitions can be employed in the final drying step.

The crystallized TNT from vessel D is melted to produce a molten stream of TNT which is passed vial line 34 to zone G wherein residual amounts of water are removed via line 44, preferably by use of a vacuum. The resulting substantially pure crystallized TNT is sent to flaked H where it is flaked for resale.

What is claimed is:

1. A process for recovering the components of a munition containing explosive components and non-explosive components, wherein the explosive components are comprised of RDX in a TNT matrix and wherein the non-explosive components are selected from a liner material comprised of asphalt and a sealer material comprised of a polymeric material and which non-explosive components are of a lower density than said explosive components, which process comprises:

a) opening said munition to expose said explosive and non-explosive components;

b) removing substantially all of said explosive components and at least a portion of said non-explosive components from the munition, which explosive components and at least a portion of non-explosive components is referred to as the feed matrix, c) conducting the feed matrix to a first settling vessel containing water and wherein at least a portion of the non-explosive components rise to the surface of the water in said first setting vessel and the explosive components sink at a rate to the bottom, d) drawing-off water containing non-explosive components and passing it to a solids/liquid separation zone wherein the non-explosive solids are separated from the water;

e) recycling at least a portion of the water to settling vessel of step c) above;

f) conducting an aqueous slurry of explosive components from the bottom of said first settling vessel to a solvent contacting zone wherein the aqueous explosive components slurry is admixed with an organic solvent that is substantially immiscible in water and in which TNT is soluble and in which RDX is substantially insoluble;

g) conducting an explosive components/water/solvent admixture from said contacting zone to a second settling vessel wherein a TNT/solvent solution organic phase is formed at the upper part of the vessel and an RDX solids in water phase is formed at the bottom part of said second settling vessel;

h) drawing off the TNT/solvent solution and passing it to a liquid/liquid separation zone wherein said solvent is separated from said TNT by a boiling point differential technique thereby leaving TNT in a crystallized form;

i) collecting said solvent;

j) conducting the crystallized TNT to a drying zone to remove substantially any remaining liquid therefrom; and k) collecting the RDX solids from step g).

2. The process of claim 1 wherein the solvent is selected from the group consisting of acetone, methanol, ethanol, diethyl ether, and mixtures thereof.

3. The process of claim 2 wherein the solvent is selected from acetone and methanol.

4. The process of claim 1 wherein the technique for collecting the RDX solid from the TNT/solvent solution is filtration.

5. The process of claim 1 wherein the TNT is separated from the solvent in step h) by evaporating the solvent.

6. The process of claim 1 wherein the collected RDX solids are mixed with a mixture of isopropyl alcohol and water after removing the TNT using a solvent wash.

7. The process of claim 1 wherein the solvent, after TNT recovery, is condensed and recycled.

8. The process of claim 1 wherein water is continuously introduced at the bottom half of said first settling vessel at a rate lower than the settling rate of the explosive components.

9. The process of claim 1 wherein sealer material is removed from the feed matrix prior to the feed matrix being conducted to said first settling vessel.

10. The process of claim 1 wherein said RDX solids collected from step g) contain a coating of desensitizing agent, which RDX solids are contacted with a paraffinic solvent at conditions to dissolve said desensitizing agent therefrom.

11. The process of claim 10 wherein the desensitizing agent is a natural or synthetic wax and wherein the paraffinic solvent is hexane.

12. The process of claim 1 wherein the collected RDX solids are collected in a slurry comprised of RDX solids, isopropyl alcohol, and water.

13. A process for recovering the components of a munition containing explosive components and non-explosive components, wherein the explosive components are comprised of RDX in a TNT matrix and wherein the non-explosive components are selected from a liner material comprised of asphalt and a sealer material comprised of a polymeric material and which non-explosive components are of a lower density than said explosive components, which process comprises:

a) opening said munition to expose said explosive and non-explosive components;

b) removing substantially all of said explosive components and at least a portion of said non-explosive components from the munition, which explosive components and at least a portion of non-explosive components is referred to as the feed matrix;

c) conducting the feed matrix to a first settling vessel containing water and wherein at least a portion of the non-explosive components rise to the surface of the water in said first settling vessel and the explosive components sink at a rate to the bottom;

d) drawing-off water containing non-explosive components and passing it to a solids/liquid separation zone wherein the non-explosive solids are separated from the water;

e) recycling at least a portion of the water to settling vessel of step c) above;

f) conducting an aqueous slurry of explosive components from the bottom of said first settling vessel to a solvent contacting zone wherein the aqueous explosive components slurry is admixed with an organic solvent that is substantially immiscible in water and in which TNT is soluble and in which RDX is substantially insoluble;

g) conducting an explosive components/water/solvent admixture from said contacting zone to a second settling vessel wherein a TNT/solvent solution organic phase contaminated with RDX is formed at the upper part of the vessel and an RDX solids in water phase is formed at the bottom part of said second settling vessel;

h) drawing off the TNT/solvent solution contaminated with RDX and passing it to a separation zone;

i) introducing an effective amount of water into said separation zone to cause at least a portion of the RDX to crystallize;

j) conducting a slurry of crystallized RDX, water, and solvent contaminated with TNT from said separation zone to a clean-up zone wherein a solvent in which TNT is substantially soluble and in which RDX is substantially insoluble is introduced to separate TNT from the remaining components and drawing off a solution of TNT and solvent from said clean-up zone thereby leaving a mixture of RDX and water, k) introducing a mixture of isopropyl alcohol and water into said clean-up zone containing crystallized RDX and water;

l) drawing off a mixture of RDX in isopropyl alcohol and water from said clean-up zone;

m) separating solvent from TNT in said separation zone of step h) by a boiling point differential technique thereby leaving TNT in a crystallized form;

n) collecting said solvent;

o) conducting the crystallized TNT to a drying zone to remove substantially any remaining liquid therefrom; and p) collecting the RDX solids from step g).

14. The process of claim 13 wherein the solvent is selected from the group consisting of acetone, methanol, ethanol, diethyl ether, and mixtures thereof.

15. The process of claim 14 wherein the solvent is selected from acetone and methanol.

16. The process of claim 13 wherein the technique for collecting the RDX solids from the TNT/solvent solution is filtration.

17. The process of claim 13 wherein the TNT is separated from the solvent in step h) by evaporating the solvent.

18. The process of claim 13 wherein the solvent, after TNT recovery, is condensed and recycled.

19. The process of claim 13 wherein water is continuously introduced at the bottom half of said first settling vessel at a rate lower than the settling rate of the explosive components.

20. The process of claim 13 wherein sealer material is removed from the feed matrix prior to the feed matrix being conducted to said first settling vessel.

21. The process of claim 13 wherein said RDX solids collected from step g) contain a coating of desensitizing agent, which RDX solids are contacted with a paraffinic solvent at conditions to dissolve said desensitizing agent therefrom.

22. The process of claim, 21 wherein the desensitizing agent is a natural or synthetic wax and wherein the paraffinic solvent is hexane.

23. The process of claim 13 wherein the collected RDX solids are collected in a slurry comprised of RDX solids, isopropyl alcohol, and water.

* * * * *